US005879154A

United States Patent [19]

Suchovsky

[11] Patent Number: 5,879,154

[45] Date of Patent: Mar. 9, 1999

[54] FLAME SPREADER-TYPE FUEL BURNER WITH LOWERED NOX EMISSIONS

[75] Inventor: Carl J. Suchovsky, Northfield, Ohio

[73] Assignee: Rheem Manufacturing Company, New York, N.Y.

[21] Appl. No.: 751,304

[22] Filed: Nov. 18, 1996

[51] Int. Cl.[6] ..... F23D 13/18

[52] U.S. Cl. ..... 431/326; 431/347; 431/329; 126/39 E; 126/355; 126/359; 126/110 B; 122/14; 122/17

[58] Field of Search ..... 431/326, 347, 431/329; 126/110 B, 355, 359, 39 E, 51; 122/17, 13–18

[56] References Cited

U.S. PATENT DOCUMENTS

| | | | |
|---|---|---|---|
| 951,060 | 3/1910 | vanden Driessche . | |
| 4,134,719 | 1/1979 | Velie | 431/171 |
| 4,372,290 | 2/1983 | Visos et al. | 126/355 |
| 4,934,927 | 6/1990 | Swiatosz | 431/171 |
| 5,307,800 | 5/1994 | Lee, Jr. | 126/110 B |
| 5,317,992 | 6/1994 | Joyce | 122/14 |
| 5,355,841 | 10/1994 | Moore, Jr. et al. | 122/17 |
| 5,427,525 | 6/1995 | Shukla et al. | 431/350 |
| 5,435,716 | 7/1995 | Joyce | 431/7 |
| 5,439,372 | 8/1995 | Duret et al. | 431/7 |
| 5,464,006 | 11/1995 | Ledjeff et al. | 126/361 |
| 5,494,003 | 2/1996 | Bartz et al. | 122/17 |
| 5,511,516 | 4/1996 | Moore, Jr. et al. | 122/17 |

*Primary Examiner*—Larry Jones
*Attorney, Agent, or Firm*—Konneker & Smith, P.C.

[57] ABSTRACT

A fuel-fired water heater is provided with a flame spreader-type fuel burner assembly that reduces the operating NOx emissions of the water heater. The assembly includes a radial port gas burner coaxially disposed in a facing relationship with a generally inverted dish-shaped flame spreader which intercepts and is impinged on its concave side by the burner flames. In various disclosed embodiments of the flame spreader, during operation of the burner the burner flames pass through spaced series of openings extending through the flame spreader body inwardly of its outer edge periphery instead of being deflected horizontally outwardly past such periphery before passing upwardly beyond the flame spreader. The passage of the previously generated burner flames through these various openings serves to materially reduce the burner NOx emissions compared to a burner having an associated flame spreader with a conventional imperforate construction.

23 Claims, 3 Drawing Sheets

FIG.4
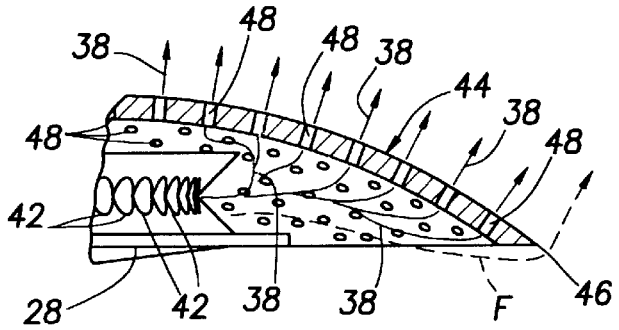
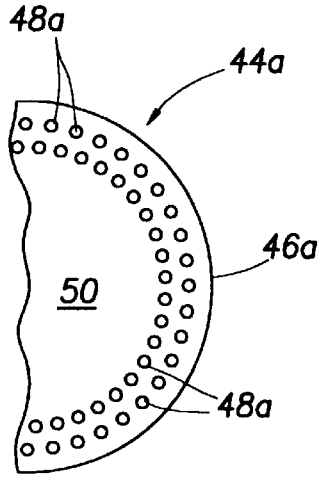
FIG.5
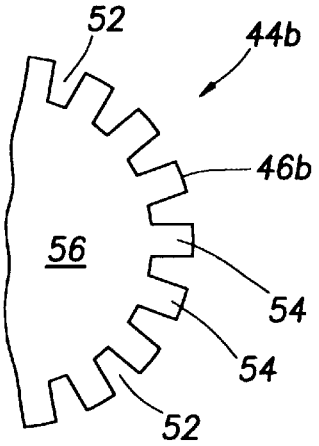
FIG.6
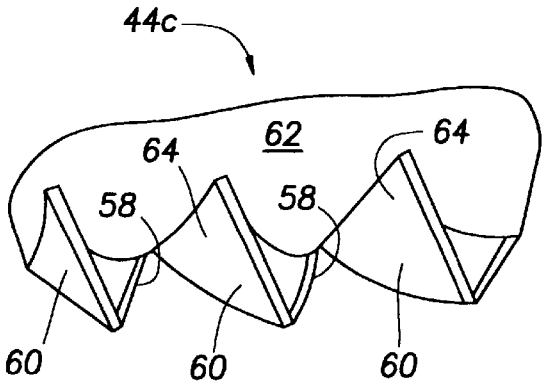
FIG.7

FLAME SPREADER-TYPE FUEL BURNER WITH LOWERED NOX EMISSIONS

BACKGROUND OF THE INVENTION

The present invention generally relates to fuel burner apparatus and, in a preferred embodiment thereof, more particularly relates to a heating appliance having a specially designed flame spreader-type fuel burner with lowered NOx (i.e., oxides of nitrogen) emissions.

Fuel-fired heating appliances such as furnaces, boilers and water heaters typically utilize combustion heat from a burner structure to controllably add heat to a heated medium such as air or water as the case may be. As might be imagined, these burner structures come in a wide variety of types, constructions and designs—each having its design strengths and weaknesses. In one particular type of fuel burner, to which the present invention is directed, a burner member from which flames emanate is positioned beneath a device typically referred to as a "flame spreader".

The flame spreader is typically a solid sheet of metal or other suitable noncombustible material, has a circular flat disc shape or a downwardly concave "hubcap" shape, and has a peripheral edge portion which is horizontally outwardly spaced apart from the actual flame generating burner section of the overall burner apparatus. As the burner flames travel upwardly they impinge on the bottom side of the flame spreader and are horizontally deflected thereby until they reach the peripheral flame spreader edge and turn upwardly past such edge. The purpose of flame spreaders of this general type is to stabilize and shape their underlying burner flame. Illustrative of this type of burner/flame spreader apparatus is the burner structure depicted and described in U.S. Pat. No. 4,134,719 to Velie.

In flame spreader-types of fuel burners, in common with other types of fuel burners, an increasingly stringent design requirement is the reduction NOx emissions from the burner. It would thus be desirable to provide a fuel burner of the flame spreader type which had a lowered NOx emission level, and to obtain this goal without greatly increasing the cost of the overall burner assembly. It is accordingly an object of the present invention to provide such a lowered NOx emission flame spreader-type burner for use in a fuel-fired heating appliance.

SUMMARY OF THE INVENTION

In carrying out principles of the present invention, in accordance with a preferred embodiment thereof, a fuel-fired heating appliance, representatively a water heater, is provided with a specially designed flame spreader-type fuel burner apparatus which materially reduces the NOx emissions generated by the appliance during the operation thereof. The fuel burner apparatus is operative to supply heat to a heat exchange portion of the appliance which, in turn, transfers the received heat to the appliance's heatable fluid such as air or water.

From a broad perspective, the fuel burner apparatus includes (1) a burner structure, representatively a radial port burner, operative to receive fuel from a source thereof and discharge the fuel for ignition to create flames that may be flowed away from the burner structure in a final flame direction; (2) a flame spreader having a generally plate-like body centered about an axis generally parallel to the final flame direction and having first and second opposite side surfaces, a peripheral edge, and a central section outwardly circumscribed by said peripheral edge, said flame spreader being positioned to intercept and be impinged upon by the created flames, with the central section of the body being in an opposing, spaced apart relationship with the burner structure, and the first side surface facing the burner structure; and (3) a mutually spaced series of opening means formed in the flame spreader body, extending therethrough from its first side surface to its opposite second side surface, and through which the created flames may pass during operation of the burner structure, the opening means being operative on the created flames to substantially reduce the NOx emissions generated thereby during operation of the burner structure.

In various illustrative embodiments thereof, in which the flame spreader is formed from metal and has an inverted dish shape, the opening means comprise (1) perforations formed over essentially the entire flame spreader, (2) perforations formed over only an annular area inwardly adjacent the flame spreader body peripheral edge, thereby leaving an imperforate central section of the body circumscribed by the perforations, (3) a crenelated area formed around the peripheral edge and defined by a circumferentially spaced series of radial notches formed in the peripheral edge, and (4) a circumferentially spaced series of axially sloped flame passages formed around the peripheral edge and defined between adjacent pairs of twisted peripheral tab portions of the flame spreader body.

BRIEF DESCRIPTION OF THE DRAWINGS

FIG. 4 is an enlarged scale detail view of the circled burner assembly area "4" in FIG. 3;

FIG. 5 is a top plan view of a portion of a first alternative embodiment of the flame spreader portion of the burner assembly;

FIG. 6 is a top plan view of a portion of a second alternative embodiment of the flame spreader portion of the burner assembly; and FIG. 7 is a peripheral edge perspective view of a third alternative embodiment of the flame spreader portion of the burner assembly.

DETAILED DESCRIPTION

Figure 1:
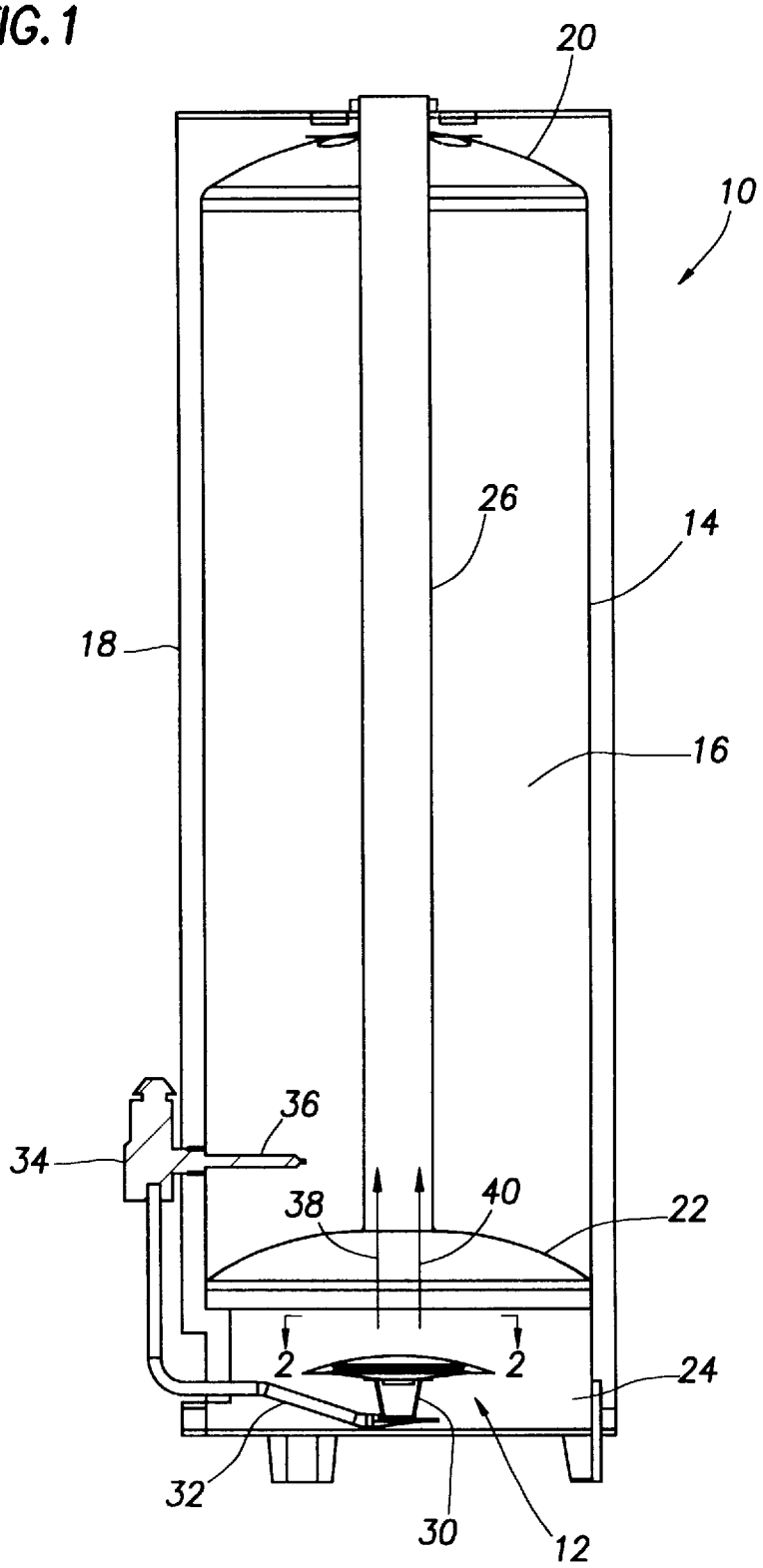
FIG. 1 is a schematic cross-sectional view, partially in elevation, through a representative fuel-fired water heater having incorporated therein a specially designed, lowered NOx reduction flame spreader-type burner assembly embodying principles of the present invention.

Illustrated in FIG. 1 in somewhat simplified form is a fuel-fired heating appliance, representatively a water heater 10, incorporating therein a specially designed flame spreader-type fuel burner assembly 12 having lowered NOx emission levels and embodying principles of the present invention. With the exception of the specially designed burner assembly 12, the water heater 10 is of a generally conventional construction and includes a vertically oriented hollow cylindrical storage tank 14 defining therein an interior chamber 16 for containing water to be heated. Tank 14 is enveloped by an insulating jacket structure 18, has upwardly domed top and bottom head sections 20 and 22, and has suitable water inlet and outlet openings (not shown).

The bottom head 22 forms an upper boundary of an internal bottom end chamber 24 within the water heater 10, and a central vertical exhaust flue 26 extends upwardly through the interior of the water chamber 16. At its upper end the exhaust flue 26 sealingly extends upwardly through the top head section 20 and is connectable to an external vent stack (not shown). At its lower end the exhaust flue 26 is sealingly connected to the bottom head section 22 and communicates with the interior of the bottom end chamber 26.

With reference now to FIGS. 1–4, the burner assembly 12 representatively includes a generally disc-shaped horizontally oriented radial port gas burner 28 (see FIGS. 3 and 4) disposed within the bottom end chamber 24 (see FIG. 1) and positioned atop a burner support bracket 30. Burner support bracket 30, in turn, is positioned atop the outlet end of a gas supply tube 32 that extends inwardly through the bottom end of the water heater 10, into the bottom end chamber 24, from a conventional combination thermostat/gas valve structure 34 externally mounted on the water heater and having a water temperature sensing element 36 sealingly extending through the tank 14 into the tank chamber 16.

During periods of water heating demand, the burner assembly 12 creates flames 38 and resulting hot combustion products 40 (see FIG. 1) which are flowed upwardly through the flue 26 and used to heat water stored in the tank chamber 16 by heat transfer through the bottom head 22 and the central flue 26. As best illustrated in FIG. 4, using a suitable ignitor structure (not shown) the flames 38 are created from gaseous fuel delivered to the burner 28 via the gas tube 32 and horizontally emanating from radial ports 42 spaced around the periphery of the burner 28. If desired, another type of burner could be used in which the flames vertically exit the burner.

Figure 2:
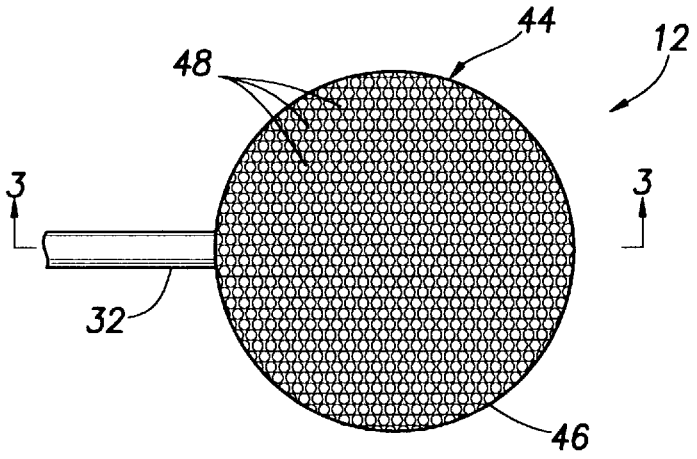
FIG. 2 is an enlarged scale top plan view of the burner assembly taken along line 2—2 of FIG. 1.
Figure 3:
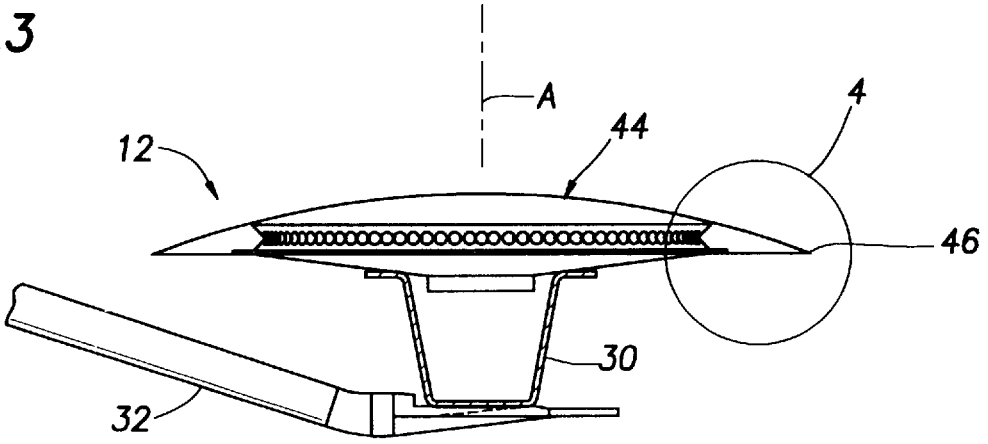
FIG. 3 is a simplified, enlarged scale cross-sectional view taken through the burner assembly along line 3—3 of FIG. 2.

Referring now to FIGS. 2–4, the burner 28 underlies a central bottom side portion of a specially designed flame spreader 44 that embodies principles of the present invention and, in a simple and quite economical manner, substantially lowers the NOx emission levels of the burner assembly 12 without requiring any appreciable modification of the balance of the burner assembly 12.

As representatively illustrated herein, the flame spreader 44 is formed from a sheet metal material and has a downwardly concave disc shape with a circular peripheral edge 46 that is positioned horizontally outwardly beyond the peripheral edge of the burner 28. Alternatively, the flame spreader 44 could have a generally flat configuration and be formed from another suitable material such an appropriate ceramic material. Flame spreader 44 is centered about a vertical axis A and is coaxial with the burner 28.

In a conventionally configured flame spreader, such as the flame spreaders illustrated and described in the aforementioned U.S. Pat. No. 4,134,719 to Velie, the flame spreader serves to stabilize and "shape" the flame and has an imperforate plate-like body. Accordingly, the flames generated by the underlying burner (whether such flames are horizontally or vertically generated) are forced to impinge on the underside of the flame spreader body and then (as illustrated by the dashed line F in FIG. 4) flow past the flame spreader peripheral edge before passing vertically past the flame spreader.

However, according to a key aspect of the present invention, shown in FIGS. 2 and 4 herein, the illustrated flame spreader 44, over essentially its entire extent, has small perforations 48 formed therethrough. Thus, when the flames 38 are generated by the burner beneath the flame spreader 44, they flow upwardly through the perforations 48 (i.e., generally vertically in the effective final flame direction), as illustrated in FIG. 4, instead of being entirely diverted outwardly around the peripheral flame spreader edge 46. This simple modification of the flame spreader has been found to substantially decrease the NOx emissions generated by the burner assembly 12.

One of skill and experience in this particular area of the combustion art might well predict that any deviation from the imperforate, horizontal baffling characteristics conventionally designed into a flame spreader of this sort would be unacceptable since it would undesirably reduce both the flame stabilization and shaping functions the spreader. However, in developing the present invention it has been found that, quite surprisingly, even the perforation of the entire flame spreader body does not unacceptably degrade either the flame shaping or spreading capabilities of the flame spreader 44 while substantially decreasing the NOx emissions of the water heater 10.

A first representative alternate embodiment 44*a* of the flame spreader 44 is partially illustrated in top plan view in FIG. 5 and has a circular peripheral edge 46*a*. Instead of being fully perforated like the flame spreader 44, the flame spreader 44*a* has perforations 48*a* formed in a relatively narrow annular pattern inwardly adjacent the peripheral edge 46*a*, thereby leaving on the flame spreader 44*a* a generally circular imperforate central body portion 50 circumscribed by the annular array of perforations 48*a*. During operation of the underlying fuel burner, the flames 38 would, of course, flow upwardly through these perforations 48*a*.

A second representative alternate embodiment 44*b* of the flame spreader 44 is partially illustrated in top plan view in FIG. 6 and has a crenelated peripheral edge 46*b* defined by a circumferentially spaced series of rectangular notches 52 disposed in the edge 46*b* and forming therebetween a circumferentially spaced of rectangular tabs 54 around the edge 46*b*. During operation of the underlying fuel burner, the flames 38 flow upwardly through the peripheral notches 52 radially outwardly of a generally circular imperforate central portion 56 of the flame spreader 44*b*.

A portion of a third representative alternate embodiment 44*c* of the flame spreader 44 is perspectively illustrated in FIG. 6 and has a circumferentially spaced series of radial slits 58 formed around its outer peripheral edge to form therebetween a circumferentially extending series of rectangular tabs 60 that circumscribe a generally circular imperforate central portion 62 of the flame spreader 44*c*. As illustrated, the tabs 60 resulting from the formation of the slits 58 are suitably twisted away from their generally horizontal orientations into vertically angled orientations to thereby form therebetween a circumferentially spaced series of vertically angled peripheral flame passages 64 each being disposed between an adjacent pair of tabs 60. During operation of the underlying fuel burner, flames pass upwardly through these peripheral passages.

In each of the four representatively illustrated flame spreader embodiments 44,44*a*,44*b* and 44*c* the flame spreader is disposed generally transversely to the desired final flame direction of its underlying fuel burner. The various flame spreader through-body flow passages 48,48*a*, 52 and 64 are disposed inwardly of their associated flame spreader body peripheral edges and advantageously function to substantially reduce the NOx emissions of their underlying fuel burners without substantial additional expense or other modification of the overall burner assemblies. It is to be understood, of course, that these described embodiments are merely representative, and the illustrated auxiliary flame passages could have a variety of other shapes, arrangements and positioning on their associated flame spreaders if desired. Additionally, the unique flame spreader modification principles illustrated and described herein could also be advantageously employed in a variety of types of fuel-fired heating appliances other than the illustrative water heater 10, such as boilers, furnaces and the like.

The foregoing detailed description is to be clearly understood as being given by way of illustration and example only, the spirit and scope of the present invention being limited solely by the appended claims.

What is claimed is:

1. Fuel burner apparatus comprising:

a burner structure operative to receive fuel from a source thereof and discharge the fuel for ignition to create flames that may be flowed away from said burner structure in a final flame direction;

a flame spreader having a generally plate-like body centered about an axis generally parallel to said final flame direction and having first and second opposite side surfaces, a peripheral edge, and a central section outwardly circumscribed by said peripheral edge, said flame spreader being positioned to intercept and be impinged upon by the created flames, with said central section being in an opposing, spaced apart relationship with said burner structure, and said first side surface facing said burner structure; and a mutually spaced series of opening means formed in said flame spreader body, extending therethrough from said first side surface to said second side surface, and through which the created flames may pass during operation of said burner structure, said opening means being operative on the created flames to substantially reduce the NOx emissions generated thereby during operation of said burner structure.

2. The fuel burner apparatus of claim 1 wherein:

said mutually spaced series of opening means are disposed inwardly of said peripheral edge of said flame spreader body.

3. The fuel burner apparatus of claim 2 wherein:

said flame spreader body is essentially entirely perforated with said mutually spaced series of opening means.

4. The fuel burner apparatus of claim 2 wherein:

said mutually spaced series of opening means are disposed in an annular array disposed inwardly adjacent said peripheral edge and outwardly circumscribing a central imperforate section of said flame spreader body.

5. The fuel burner apparatus of claim 1 wherein:

said peripheral edge has a spaced series of notches formed therein and defining said mutually spaced series of opening means.

6. The fuel burner apparatus of claim 1 wherein:

said peripheral edge has a spaced series of slits formed therein to define a series of peripheral tabs on said flame spreader body, said tabs being twisted in a manner forming said mutually spaced series of opening means between adjacent tab pairs.

7. The fuel burner apparatus of claim 6 wherein:

each adjacent tab pair forms therebetween an axially sloped passage through which the created flames may pass.

8. The fuel burner apparatus of claim 1 wherein:

said flame spreader body has a generally circular shape.

9. The fuel burner apparatus of claim 8 wherein:

said flame spreader body has a generally inverted dish-shaped configuration, with said first side surface being convexly curved.

10. The fuel burner apparatus of claim 1 wherein:

said flame spreader body is of a metal material.

11. The fuel burner apparatus of claim 1 wherein:

said burner structure is a radial port burner disposed generally coaxially with said flame spreader body.

12. A fuel-fired heating appliance operative to transfer heat to a heatable fluid, comprising heat transfer means for receiving heat from a source thereof and transferring the received heat to the heatable fluid; and heat supplying means for supplying heat to said heat transfer means, said heat supplying means comprising fuel burner apparatus including (1) a burner structure operative to receive fuel from a source thereof and discharge the fuel for ignition to create flames that may be flowed away from said burner structure in a final flame direction, (2) a flame spreader having a generally plate-like body centered about an axis generally parallel to said final flame direction and having first and second opposite side surfaces, a peripheral edge, and a central section outwardly circumscribed by said peripheral edge, said flame spreader being positioned to intercept and be impinged upon by the created flames, with said central section being in an opposing, spaced apart relationship with said burner structure, and said first side surface facing said burner structure, and (3) a mutually spaced series of opening means formed in said flame spreader body, extending therethrough from said first side surface to said second side surface, and through which the created flames may pass during operation of said burner structure, said opening means being operative on the created flames to substantially reduce the NOx emissions generated thereby during operation of said burner structure.

13. The fuel-fired heating appliance of claim 12 wherein:

said mutually spaced series of opening means are disposed inwardly of said peripheral edge of said flame spreader body.

14. The fuel-fired heating appliance of claim 13 wherein:

said flame spreader body is essentially entirely perforated with said mutually spaced series of opening means.

15. The fuel-fired heating appliance of claim 13 wherein:

said mutually spaced series of opening means are disposed in an annular array disposed inwardly adjacent said peripheral edge and outwardly circumscribing a central imperforate section of said flame spreader body.

16. The fuel-fired heating appliance of claim 12 wherein:

said peripheral edge has a spaced series of notches formed therein and defining said mutually spaced series of opening means.

17. The fuel-fired heating appliance of claim 12 wherein:

said peripheral edge has a spaced series of slits formed therein to define a series of peripheral tabs on said flame spreader body, said tabs being twisted in a manner forming said mutually spaced series of opening means between adjacent tab pairs.

18. The fuel-fired heating appliance of claim 17 wherein:

each adjacent tab pair forms therebetween an axially sloped passage through which the created flames may pass.

19. The fuel-fired heating appliance of claim 12 wherein:

said flame spreader body has a generally circular shape.

20. The fuel-fired heating appliance of claim 19 wherein:

said flame spreader body has a generally inverted dish-shaped configuration, with said first side surface being convexly curved.

21. The fuel-fired heating appliance of claim 12 wherein:

said flame spreader body is of a metal material.

22. The fuel-fired heating appliance of claim 12 wherein:

said burner structure is a radial port burner disposed generally coaxially with said flame spreader body.

23. The fuel-fired heating appliance of claim 12 wherein:

said fuel-fired heating appliance is a water heater.

* * * * *